US005864795A

United States Patent [19]

Bartkowiak

[11] Patent Number: 5,864,795

[45] Date of Patent: Jan. 26, 1999

[54] SYSTEM AND METHOD FOR ERROR CORRECTION IN A CORRELATION-BASED PITCH ESTIMATOR

[75] Inventor: John G. Bartkowiak, Austin, Tex.

[73] Assignee: Advanced Micro Devices, Inc., Sunnyvale, Calif.

[21] Appl. No.: 603,366

[22] Filed: Feb. 20, 1996

[51] Int. Cl.[6] ..... G10L 9/08

[52] U.S. Cl. ..... 704/216; 704/207; 704/208

[58] Field of Search ..... 395/2.16, 2.18, 395/2.25, 2.26, 2.28; 704/207, 208, 209, 216

[56] References Cited

U.S. PATENT DOCUMENTS

| | | | |
|---|---|---|---|
| 4,544,919 | 10/1985 | Gerson | 341/75 |
| 4,696,038 | 9/1987 | Doddington et al. | 395/2.28 |
| 4,802,221 | 1/1989 | Jibbe | 395/2.17 |
| 4,809,334 | 2/1989 | Bhaskar | 395/2.16 |
| 4,817,157 | 3/1989 | Gerson | 395/2.39 |
| 4,896,361 | 1/1990 | Gerson | 395/2.31 |
| 5,127,053 | 6/1992 | Koch | 395/2.16 |
| 5,233,660 | 8/1993 | Chen | 381/38 |
| 5,473,727 | 12/1995 | Nishiguchi et al. | 704/222 |
| 5,649,051 | 7/1997 | Rothweiler | 704/220 |
| 5,668,925 | 9/1997 | Rothweiler et al. | 704/220 |
| 5,696,873 | 12/1997 | Bartkoeiak | 704/216 |
| 5,745,871 | 9/1991 | Chen | 704/207 |

FOREIGN PATENT DOCUMENTS 0 125 423 11/1984 European Pat. Off. .

OTHER PUBLICATIONS

Krubsack, D.A. et al., "An Autocorrelation Pitch Detector and Voicing Decision With Confidence Measures Developed for Noise–Corrupted Speech, " IEEE Transactions on Signal Processing, vol. 39, No. 2, Feb. 1, 1991, pp. 319–329.

Lefevre, J.P. et al., "Pitch Detection Based on Localization Signal," Signal Processing Theories and Aplications, Barcelona, Sep. 18–21, 1990, vol. 2, Torres, pp. 1159–1162.

Gao, Yang et al., "A Fast Celp Vocoder With Efficient Computation of Pitch, " Signal Processing Theories and Applications, vol. 1, 24–27, Aug. 1992, Brussels, pp. 511–514.

ICASSP 82 Proceedings, May 3, 4, 5, 1982, Palais Des Congres, Paris, France, Sponsored by the Institute of Electrical and Electronics Engineers, Acoustics, Speech, and Signal Processing Society, vol. 2 of 3, IEEE International Conference on Acoustics, Speech and Signal Processing, pp. 651–654.

(List continued on next page.)

*Primary Examiner*—David R. Hudspeth
*Assistant Examiner*—Daniel Abebe
*Attorney, Agent, or Firm*—Conley, Rose & Tayon; Jeffrey C. Hood

[57] ABSTRACT

An improved vocoder system and method for estimating pitch in a speech waveform. The vocoder receives digital samples of a speech waveform and generates a plurality of parameters based on the speech waveform, including a pitch parameter. The present invention comprises an improved method for estimating and correcting the pitch parameter using correlation techniques. The method comprises first performing a correlation calculation on a frame of the speech waveform, which produces one or more correlation peaks at respective numbers of delay samples. The vocoder then compares the one or more correlation peaks with a clipping threshold value. If a single peak at location $P_d$ is greater than the clipping threshold, then the vocoder performs additional calculations to ensure that this single correlation peak is not a second or higher multiple of the true pitch. In the preferred embodiment, the vocoder assumes the peak at location $P_d$ is a second multiple of the true pitch, and the vocoder searches for the true pitch at a first multiple of the peak location $P_d$. If a peak is found at this first multiple, referred to as $P_d'$, and certain other criteria are met, then the peak at location $P_d'$ is presumed to be the true pitch. In this case, the pitch is set to the number of delay samples indicated by $P_d'$. Thus the present invention more accurately disregards false peaks which are second or higher multiples of the true pitch.

19 Claims, 8 Drawing Sheets

OTHER PUBLICATIONS

Rabiner et al. "Digital Processing of Speech Signals; Pitch Period Using the Autocorrelation Function." Prentice–Hall Signal Processing Series, pp. 150–158, D 1978.

Harris et al. "Glottal Pulse Alignment in Voiced Speech for Pitch Determination." ICASSP 93: Acoustics Speech & Signal Processing Conference.

Lee et al. "Robust Backward Adaptive Pitch Prediction for Speech Coder." Electronic Letters, vol. 31, No. 7, MA 1995

Representation of Speech Signals

Range of bit rates for various types of speech representations.

Source-system model of speech production

General discrete-time model for speech production

Block diagram of simplified model for speech production

SYSTEM AND METHOD FOR ERROR CORRECTION IN A CORRELATION-BASED PITCH ESTIMATOR

FIELD OF THE INVENTION

The present invention relates generally to a vocoder which receives speech waveforms and generates a parametric representation of the speech waveforms, and more particularly to an improved vocoder system and method for estimating pitch in a correlation-based pitch estimator.

DESCRIPTION OF THE RELATED ART

Digital storage and communication of voice or speech signals has become increasingly prevalent in modem society. Digital storage of speech signals comprises generating a digital representation of the speech signals and then storing those digital representations in memory. As shown in FIG. 1, a digital representation of speech signals can generally be either a waveform representation or a parametric representation. A waveform representation of speech signals comprises preserving the "waveshape" of the analog speech signal through a sampling and quantization process. A parametric representation of speech signals involves representing the speech signal as a plurality of parameters which affect the output of a model for speech production. A parametric representation of speech signals is accomplished by first generating a digital waveform representation using speech signal sampling and quantization and then further processing the digital waveform to obtain parameters of the model for speech production. The parameters of this model are generally classified as either excitation parameters, which are related to the source of the speech sounds, or vocal tract response parameters, which are related to the individual speech sounds.

FIG. 2 illustrates a comparison of the waveform and parametric representations of speech signals according to the data transfer rate required. As shown, parametric representations of speech signals require a lower data rate, or number of bits per second, than waveform representations. A waveform representation requires from 15,000 to 200,000 bits per second to represent and/or transfer typical speech, depending on the type of quantization and modulation used. A parametric representation requires a significantly lower number of bits per second, generally from 500 to 15,000 bits per second. In general, a parametric representation is a form of speech signal compression which uses a priori knowledge of the characteristics of the speech signal in the form of a speech production model. A parametric representation represents speech signals in the form of a plurality of parameters which affect the output of the speech production model, wherein the speech production model is a model based on human speech production anatomy.

Speech sounds can generally be classified into three distinct classes according to their mode of excitation. Voiced sounds are sounds produced by vibration or oscillation of the human vocal cords, thereby producing quasi-periodic pulses of air which excite the vocal tract. Unvoiced sounds are generated by forming a constriction at some point in the vocal tract, typically near the end of the vocal tract at the mouth, and forcing air through the constriction at a sufficient velocity to produce turbulence. This creates a broad spectrum noise source which excites the vocal tract. Explosive sounds result from creating pressure behind a closure in the vocal tract, typically at the mouth, and then abruptly releasing the air.

A speech production model can generally be partitioned into three phases comprising vibration or sound generation within the glottal system, propagation of the vibrations or sound through the vocal tract, and radiation of the sound at the mouth and to a lesser extent through the nose. FIG. 3 illustrates a simplified model of speech production which includes an excitation generator for sound excitation or generation and a time varying linear system which models propagation of sound through the vocal tract and radiation of the sound at the mouth. Therefore, this model separates the excitation features of sound production from the vocal tract and radiation features. The excitation generator creates a signal comprised of either a train of glottal pulses or randomly varying noise. The train of glottal pulses models voiced sounds, and the randomly varying noise models unvoiced sounds. The linear time-varying system models the various effects on the sound within the vocal tract. This speech production model receives a plurality of parameters which affect operation of the excitation generator and the time-varying linear system to compute an output speech waveform corresponding to the received parameters.

Referring now to FIG. 4, a more detailed speech production model is shown. As shown, this model includes an impulse train generator for generating an impulse train corresponding to voiced sounds and a random noise generator for generating random noise corresponding to unvoiced sounds. One parameter in the speech production model is the pitch period, which is supplied to the impulse train generator to generate the proper pitch or frequency of the signals in the impulse train. The impulse train is provided to a glottal pulse model block which models the glottal system. The output from the glottal pulse model block is multiplied by an amplitude parameter and provided through a voiced/unvoiced switch to a vocal tract model block. The random noise output from the random noise generator is multiplied by an amplitude parameter and is provided through the voiced/unvoiced switch to the vocal tract model block. The voiced/unvoiced switch is controlled by a parameter which directs the speech production model to switch between voiced and unvoiced excitation generators, i.e., the impulse train generator and the random noise generator, to model the changing mode of excitation for voiced and unvoiced sounds.

The vocal tract model block generally relates the volume velocity of the speech signals at the source to the volume velocity of the speech signals at the lips. The vocal tract model block receives various vocal tract parameters which represent how speech signals are affected within the vocal tract. These parameters include various resonant and unresonant frequencies, referred to as formants, of the speech which correspond to poles or zeroes of the transfer function V(z). The output of the vocal tract model block is provided to a radiation model which models the effect of pressure at the lips on the speech signals. Therefore, FIG. 4 illustrates a general discrete time model for speech production. The various parameters, including pitch, voice/unvoice, amplitude or gain, and the vocal tract parameters affect the operation of the speech production model to produce or recreate the appropriate speech waveforms.

Referring now to FIG. 5, in some cases it is desirable to combine the glottal pulse, radiation and vocal tract model blocks into a single transfer function. This single transfer function is represented in FIG. 5 by the time-varying digital filter block. As shown, an impulse train generator and random noise generator each provide outputs to a voiced/unvoiced switch. The output from the switch is provided to a gain multiplier which in turn provides an output to the time-varying digital filter. The time-varying digital filter performs the operations of the glottal pulse model block, vocal tract model block and radiation model block shown in FIG. 4.

One key aspect for generating a parametric representation of speech from a received waveform involves accurately estimating the pitch of the received waveform. The estimated pitch parameter is used later in re-generating the speech waveform from the stored parameters. For example, in generating speech waveforms from a parametric representation, a vocoder generates an impulse train comprising a series of periodic impulses separated in time by a period which corresponds to the pitch frequency of the speaker. Thus, when creating a parametric representation of speech, it is important to accurately estimate the pitch parameter. It is noted that, for an all digital system, the pitch parameter is restricted to be some multiple of the sampling interval of the system.

The estimation of pitch in speech using time domain correlation methods has been widely employed in speech compression technology. Time domain correlation is a measurement of similarity between two functions. In pitch estimation, time domain correlation measures the similarity of two sequences or frames of digital speech signals sampled at 8 KHz, as shown in FIG. 6. In a typical vocoder, 160 sample frames are used where the center of the frame is used as a reference point. As shown in FIG. 6, if a defined number of samples to the left of the point marked "center of frame" are similar to a similarly defined number of samples to the right of this point, then a relatively high correlation value is produced. Thus, detection of periodicity is possible using the so called correlation coefficient, which is defined as $$corcoef = \frac{\sum_{n=0}^{N-1} [x(n) - \overline{x}][x(n-d) - \overline{xd}]}{\sum_{n=0}^{N-1} [x(n) - \overline{x}]^2 * \sum_{n=0}^{N-1} [x(n-d) - \overline{xd}]^2} \quad \text{Eqn (1)}$$

where $$\overline{x} = \frac{1}{N} \sum_{n=0}^{N-1} [x(n)] \text{ and } \overline{x(d)} = \frac{1}{N} \sum_{n=0}^{N-1} [x(n-d)] \quad \text{Eqn's (2)\&(3)}$$

The x(n-d) samples are to the left of the center point and the x(n) samples lie to the right of the center point. This function indicates the closeness to which the signal x(n) matches an earlier-in-time version of the signal x(n-d). This function displays the property that abs[corcoef]<=1. Also, if the function is equal to 1, x(n)=x(n−d) for all n.

When the delay d becomes equal to the pitch period of the speech under analysis, the correlation coefficient, corcoef, becomes maximum. In general, pitch periods for speech lie in the range 21–147 samples at 8 KHz. Thus for example, if the pitch is 57 samples, then the correlation coefficient will be high over a range of 57 samples. Thus, correlation calculations are performed for a number of samples N which varies between 21 and 147 in order to calculate the correlation coefficient for all possible pitch periods. It is noted that a high value for the correlation coefficient will register at multiples of the pitch period, i.e., at 2 and 3 times the pitch period, producing multiple peaks in the correlation. In general, to remove extraneous peaks caused by secondary excitations (very common in voiced segments), the correlation function is clipped using a threshold function. Logic is then applied to the remaining peaks to determine the actual pitch of that segment of speech. These types of technique are commonly used as the basis for pitch estimation.

However, correlation-based techniques have limitations in accurately estimating this critical parameter under all conditions. In particular, in speech which is not totally voiced, or contains secondary excitations in addition to the main pitch frequency, the correlation-based methods can produce misleading results. These misleading results must be corrected if the speech is to be resynthesised with good quality. Pitch estimation errors in speech have a highly damaging effect on reproduced speech quality, and methods of correcting such errors play a key part in rendering good subjective quality.

Therefore, an improved vocoder system and method for performing pitch estimation is desired which more accurately estimates the pitch of a received waveform. An improved vocoder system and method is also described which more accurately disregards second and higher multiples of the true pitch.

SUMMARY OF THE INVENTION

The present invention comprises an improved vocoder system and method for estimating pitch in a speech waveform. The vocoder receives digital samples of a speech waveform, wherein the speech waveform includes a plurality of frames each comprising a plurality of samples. The vocoder generates a plurality of parameters based on the speech waveform, including a pitch parameter which is the pitch or frequency of the speech samples. The present invention comprises an improved method for estimating and correcting the pitch parameter. The present invention more accurately disregards false correlation peaks which are second or higher multiples of the true pitch.

The method comprises first performing a correlation calculation on a frame of the speech waveform. This correlation calculation produces one or more correlation peaks at respective numbers of delay samples. The vocoder then compares the one or more correlation peaks with a clipping threshold value and determines if only a single correlation peak is greater than the clipping threshold value. If only a single correlation peak is greater than the clipping threshold value, and if the peak location is higher than a certain range, then the vocoder performs additional calculations to ensure that this single correlation peak is not a second or higher multiple of the true pitch. The single correlation peak has a peak location referred to as $P_d$ comprising a first number of delay samples.

According to the present invention, the vocoder searches for one or more new peak locations $P_d'$, where the single correlation peak at $P_d$ is a multiple of these one or more new peak locations. In the preferred embodiment, the vocoder assumes the peak at location $P_d$ is a second multiple of the true pitch, and based on this assumption the vocoder computes a new location which would be the first multiple. This involves computing approximately one half of the peak location $P_d$, i.e., $P_d/2$, and searching for a correlation peak within a window of this new location $P_d/2$. If the vocoder finds a peak within this window, for example, at location $P_d'$, the vocoder examines this new peak relative to other criteria. First, the vocoder determines if the amplitude of the peak at location $P_d'$ is greater than a certain percentage of the clipping threshold. The vocoder then ensures that the location $P_d'$ is within a certain window of the pitch location of the previous frame. If these criteria are satisfied, then it is presumed that the location $P_d$ was actually a second multiple of the true pitch, and the $P_d'$ location is set as the pitch value.

Therefore, the present invention more accurately provides the correct pitch parameter in response to a sampled speech waveform. More specifically, the present invention more accurately disregards correlation peaks which are multiples of the true pitch.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Incorporation by Reference The following references are hereby incorporated by reference.

For general information on speech coding, please see Rabiner and Schafer, *Digital Processing of Speech Signals* Prentice Hall, 1978 which is hereby incorporated by reference in its entirety. Please also see Gersho and Gray, *Vector Quantization and Signal Compression,* Kluwer Academic Publishers, which is hereby incorporated by reference in its entirety.

Voice Storage and Retrieval System

Figure 1:
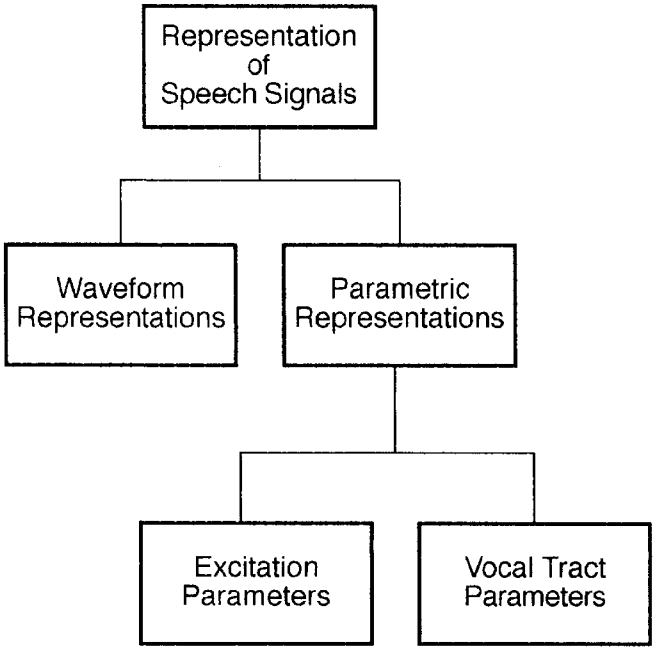
FIG. 1 (prior art)
FIG. 1 illustrates waveform representation and parametric representation methods used for representing speech signals.
Figure 2:
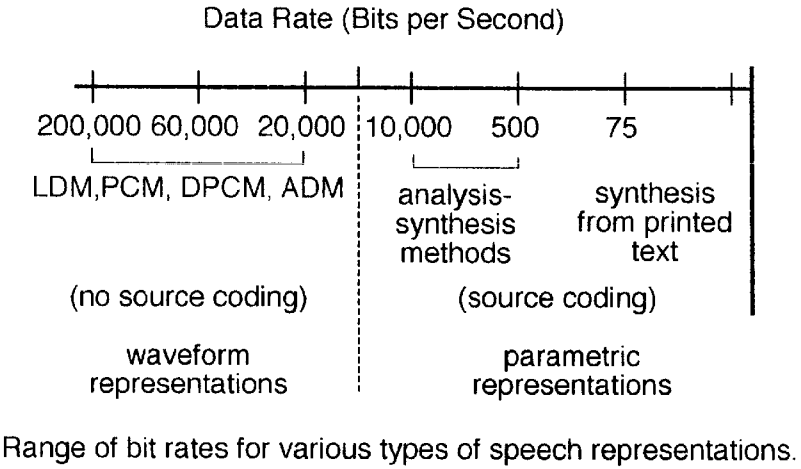
FIG. 2 (prior art)
FIG. 2 illustrates a range of bit rates for the speech representations illustrated in FIG. 1.
Figure 3:
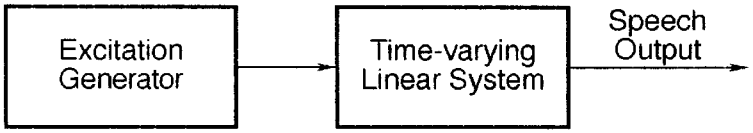
FIG. 3 (prior art)
FIG. 3 illustrates a basic model for speech production.
Figure 4:
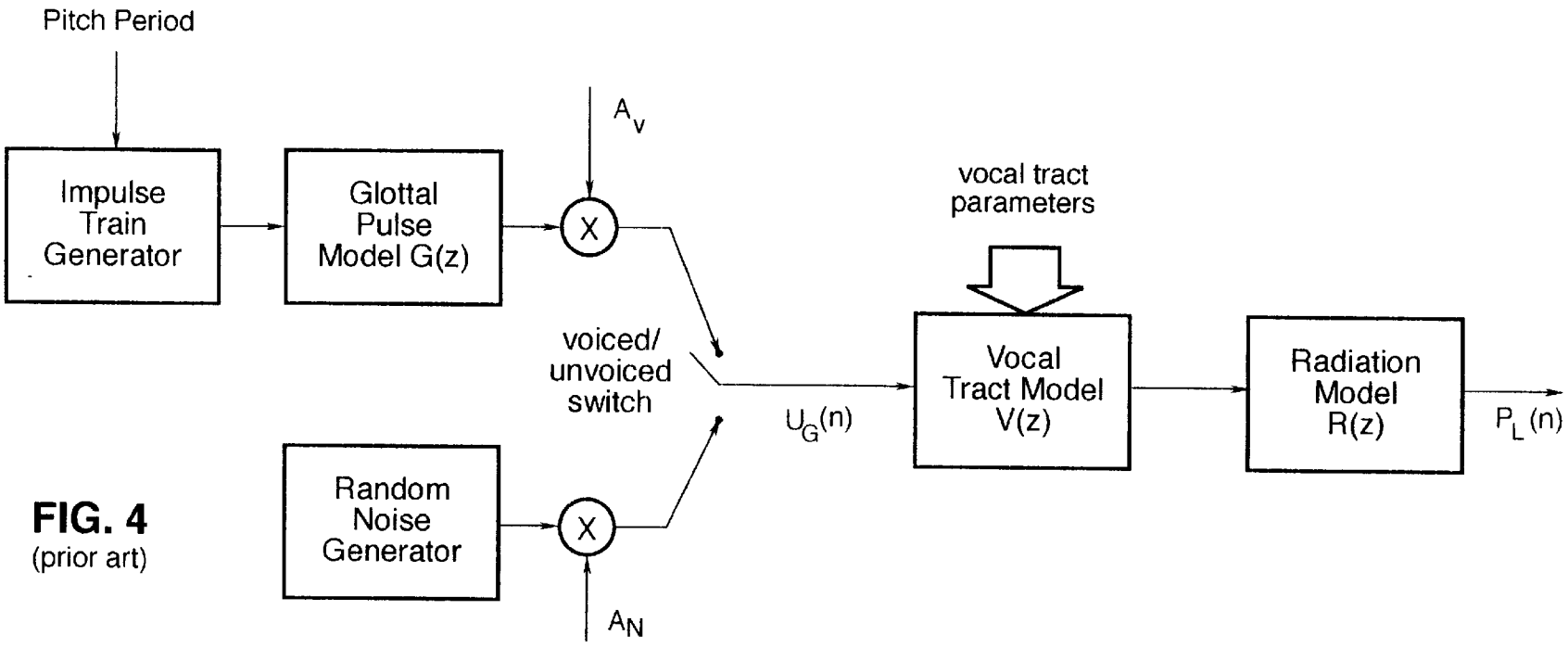
FIG. 4 (prior art)
FIG. 4 illustrates a generalized model for speech production.
Figure 5:
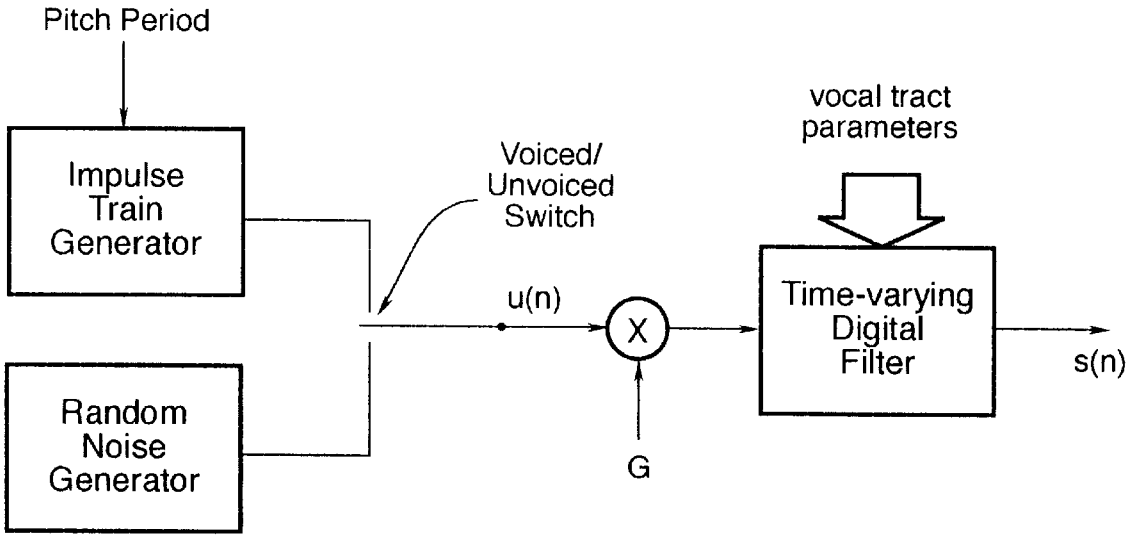
FIG. 5 (prior art)
FIG. 5 illustrates a model for speech production which includes a single time-varying digital filter.
Figure 6:
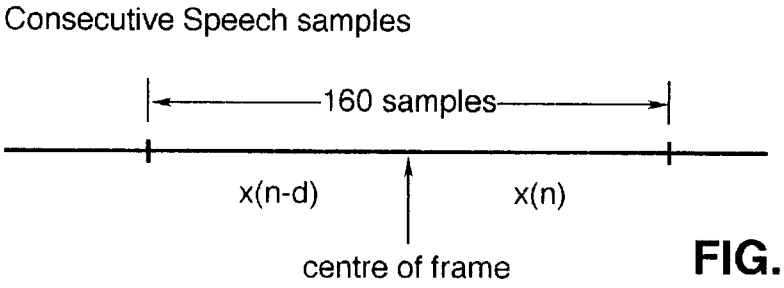
FIG. 6 illustrates a time domain correlation method for measuring the similarity of two sequences of digital speech samples.
Figure 7:
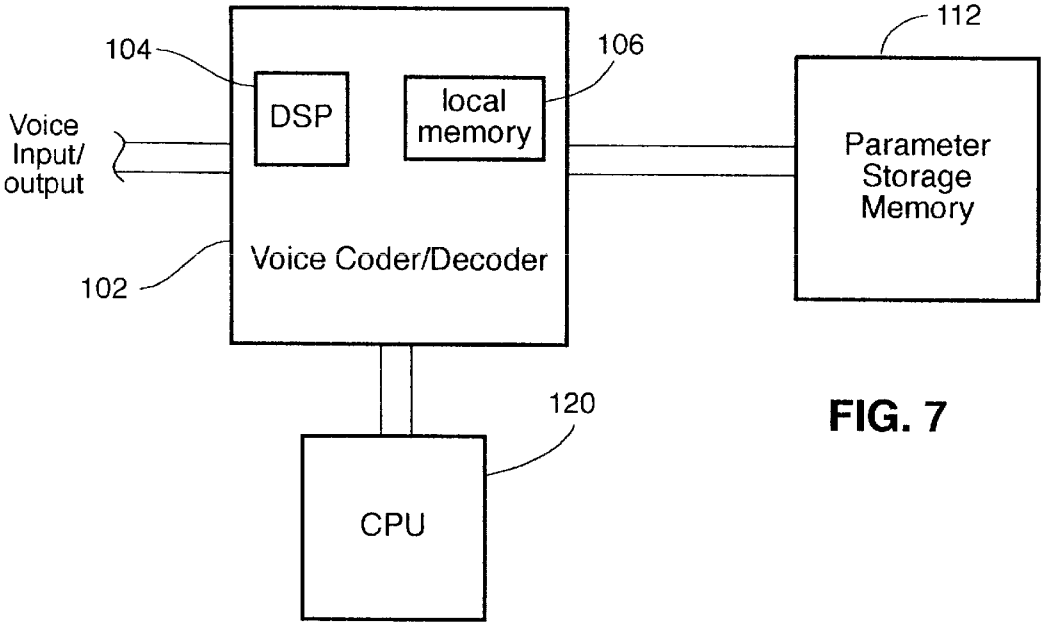
FIG. 7 is a block diagram of a speech storage system according to one embodiment of the present invention.

Referring now to FIG. 7, a block diagram illustrating a voice storage and retrieval system or vocoder according to one embodiment of the invention is shown. The voice storage and retrieval system shown in FIG. 7 can be used in various applications, including digital answering machines, digital voice mail systems, digital voice recorders, call servers, and other applications which require storage and retrieval of digital voice data. In the preferred embodiment, the voice storage and retrieval system is used in a digital answering machine.

As shown, the voice storage and retrieval system preferably includes a dedicated voice coder/decoder (codec) 102. The voice coder/decoder 102 preferably includes a digital signal processor (DSP) 104 and local DSP memory 106. The local memory 106 serves as an analysis memory used by the DSP 104 in performing voice coding and decoding functions, i.e., voice compression and decompression, as well as optional parameter data smoothing. The local memory 106 preferably operates at a speed equivalent to the DSP 104 and thus has a relatively fast access time.

The voice coder/decoder 102 is coupled to a parameter storage memory 112. The storage memory 112 is used for storing coded voice parameters corresponding to the received voice input signal. In one embodiment, the storage memory 112 is preferably low cost (slow) dynamic random access memory (DRAM). However, it is noted that the storage memory 112 may comprise other storage media, such as a magnetic disk, flash memory, or other suitable storage media. A CPU 120 is preferably coupled to the voice coder/decoder 102 and controls operations of the voice coder/decoder 102, including operations of the DSP 104 and the DSP local memory 106 within the voice coder/decoder 102. The CPU 120 also performs memory management functions for the voice coder/decoder 102 and the storage memory 112.

Alternate Embodiment

Figure 8:
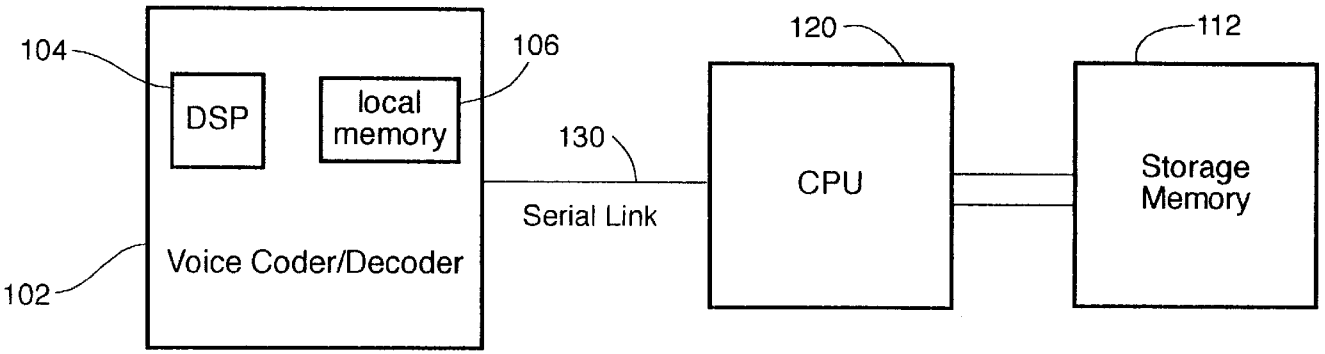
FIG. 8 is a block diagram of a speech storage system according to a second embodiment of the present invention.

Referring now to FIG. 8, an alternate embodiment of the voice storage and retrieval system is shown. Elements in FIG. 8 which correspond to elements in FIG. 7 have the same reference numerals for convenience. As shown, the voice coder/decoder 102 couples to the CPU 120 through a serial link 130. The CPU 120 in turn couples to the parameter storage memory 112 as shown. The serial link 130 may comprise a dumb serial bus which is only capable of providing data from the storage memory 112 in the order that the data is stored within the storage memory 112. Alternatively, the serial link 130 may be a demand serial link, where the DSP 104 controls the demand for parameters in the storage memory 112 and randomly accesses desired parameters in the storage memory 112 regardless of how the parameters are stored. The embodiment of FIG. 8 can also more closely resemble the embodiment of FIG. 7, whereby the voice coder/decoder 102 couples directly to the storage memory 112 via the serial link 130. In addition, a higher bandwidth bus, such as an 8-bit or 16-bit bus, may be coupled between the voice coder/decoder 102 and the CPU 120.

It is noted that the present invention may be incorporated into various types of voice processing systems having various types of configurations or architectures, and that the systems described above are representative only.

Encoding Voice Data

Figure 9:
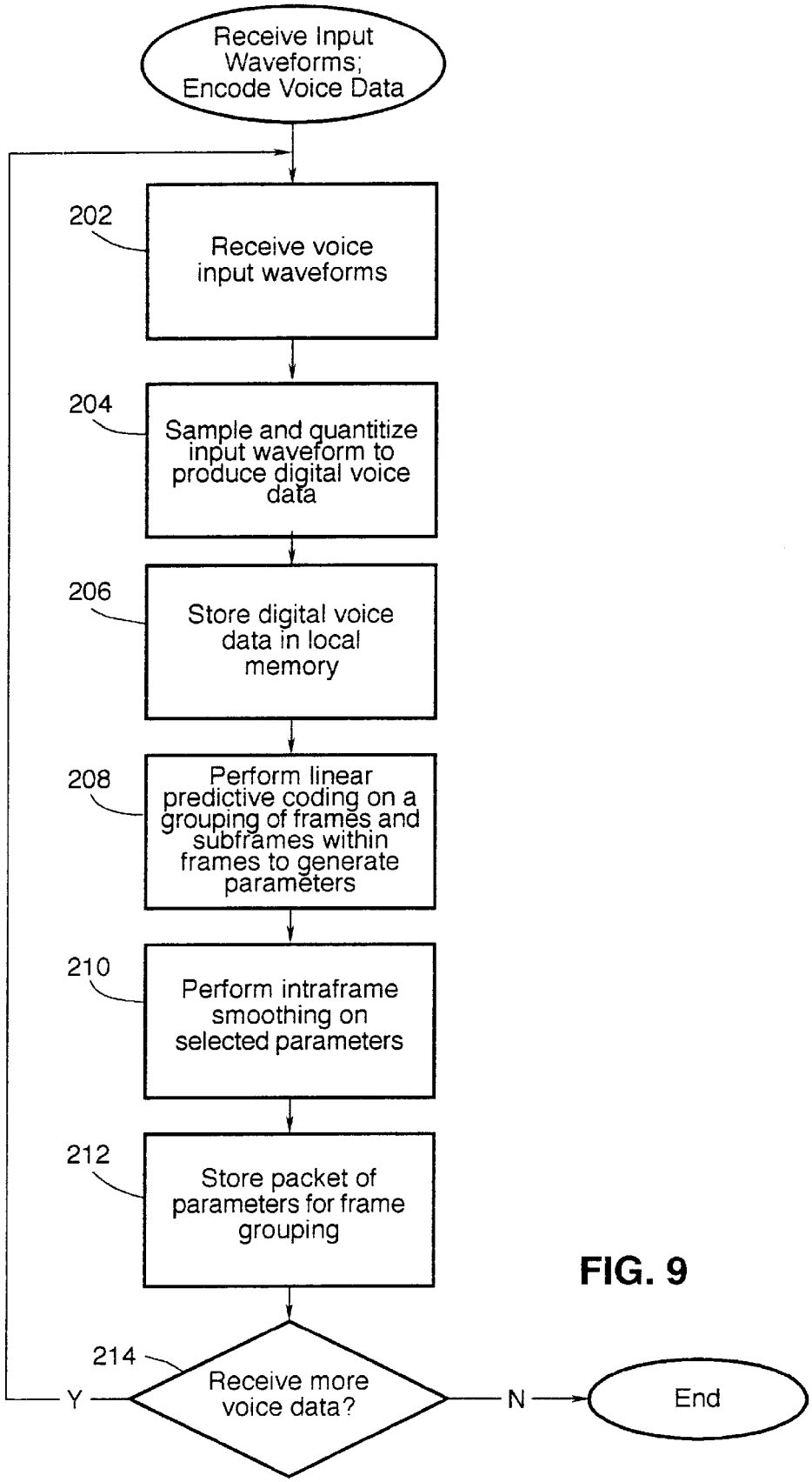
FIG. 9 is a flowchart diagram illustrating operation of speech signal encoding.

Referring now to FIG. 9, a flowchart diagram illustrating operation of the system of FIG. 7 encoding voice or speech signals into parametric data is shown. This figure illustrates one embodiment of how speech parameters are generated, and it is noted that various other methods may be used to generate the speech parameters using the present invention, as desired.

In step 202 the voice coder/decoder 102 receives voice input waveforms, which are analog waveforms corresponding to speech. In step 204 the DSP 104 samples and quantizes the input waveforms to produce digital voice data. The DSP 104 samples the input waveform according to a desired sampling rate. After sampling, the speech signal waveform is then quantized into digital values using a desired quantization method. In step 206 the DSP 104 stores the digital voice data or digital waveform values in the local memory 106 for analysis by the DSP 104.

While additional voice input data is being received, sampled, quantized, and stored in the local memory 106 in steps 202–206, the following steps are performed. In step 208 the DSP 104 performs encoding on a grouping of frames of the digital voice data to derive a set of parameters which describe the voice content of the respective frames being examined. Various types of coding methods, including linear predictive coding, may be used. It is noted that any of various types of coding methods may be used, as desired. For more information on digital processing and coding of speech signals, please see Rabiner and Schafer, *Digital Processing of Speech Signals,* Prentice Hall, 1978, which is hereby incorporated by reference in its entirety.

In step 208 the DSP 104 develops a set of parameters of different types for each frame of speech. The DSP 104 generates one or more parameters for each frame which represent the characteristics of the speech signal, including a pitch parameter, a voice/unvoice parameter, a gain parameter, a magnitude parameter, and a multi-based excitation parameter, among others. The DSP 104 may also generate other parameters for each frame or which span a grouping of multiple frames. The present invention includes a novel system and method for more accurately estimating the pitch parameter.

Once these parameters have been generated in step 208, in step 210 the DSP 104 optionally performs intraframe smoothing on selected parameters. In an embodiment where intraframe smoothing is performed, a plurality of parameters of the same type are generated for each frame in step 208. Intraframe smoothing is applied in step 210 to reduce these plurality of parameters of the same type to a single parameter of that type. However, as noted above, the intraframe smoothing performed in step 210 is an optional step which may or may not be performed, as desired.

Once the coding has been performed on the respective grouping of frames to produce parameters in step 208, and any desired intraframe smoothing has been performed on selected parameters in step 210, the DSP 104 stores this packet of parameters in the storage memory 112 in step 212. If more speech waveform data is being received by the voice coder/decoder 102 in step 214, then operation returns to step 202, and steps 202–214 are repeated.

Errors Which Occur Using Correlation

Figures 10A, 10B, 10C:
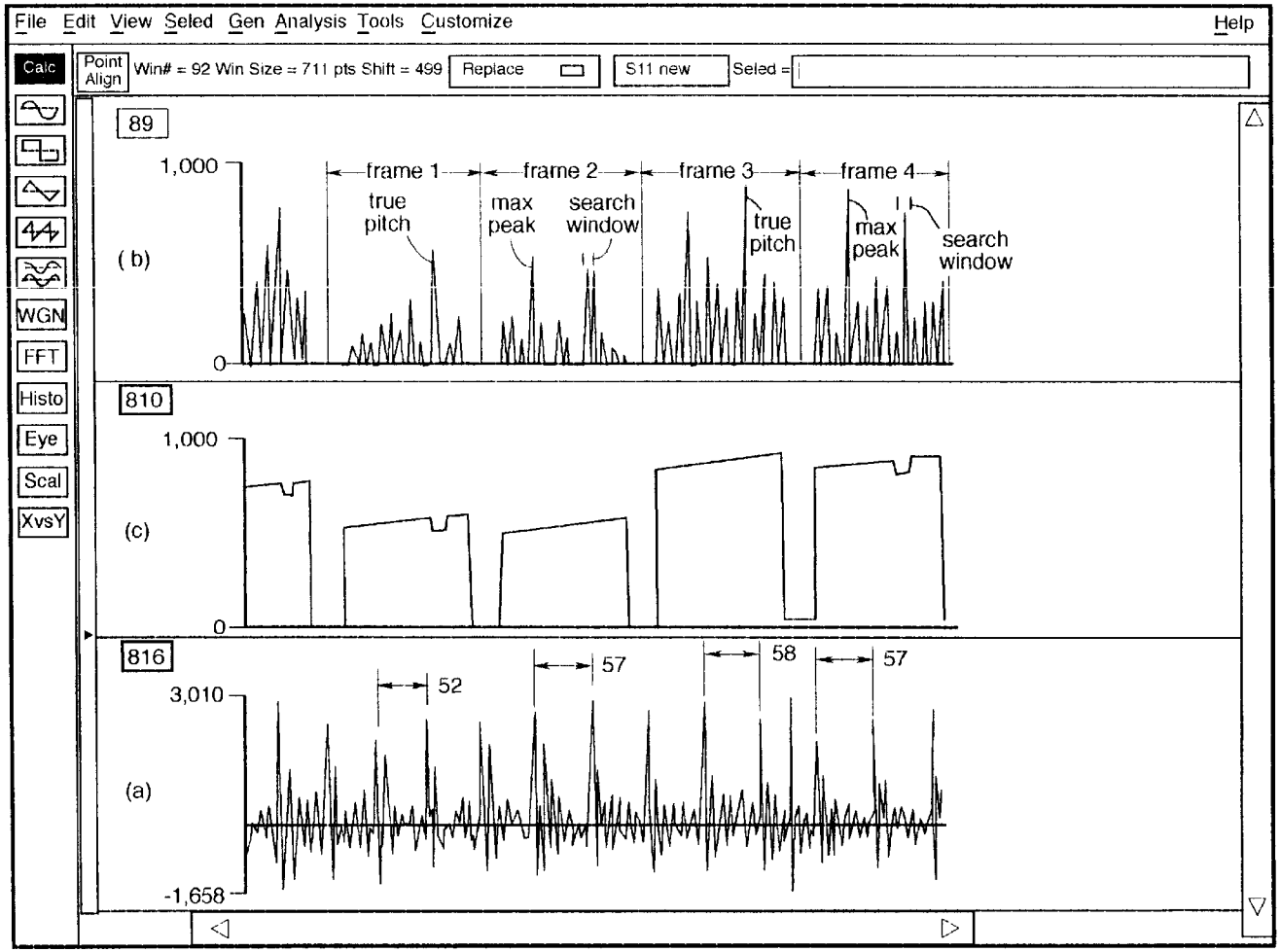
FIG. 10A illustrates a sample speech waveform.
FIG. 10B illustrates a correlation output from the speech waveform of FIG. 10A using a frame size of 160 samples.
FIG. 10C illustrates the clipping threshold used to reduce the number of peaks in the estimation process.

FIG. 10A illustrates a sequence of speech samples where the period of the pitch is clearly identifiable by the large amplitude spikes in the time domain waveform. FIG. 10B shows the results of using correlation techniques with a frame size of 160 samples using equations 1,2 and 3 recited above. FIG. 10C shows the clipping threshold used to reduce the number of peaks used in the estimation process. As shown, the horizontal axes of FIGS. 10B and 10C are measured in delay samples for each individual frame, and vary from 0 to 160, going from right to left.

As shown in the correlation results of FIG. 10B, in frame 1 a strong correlation peak exists at a delay of 52 samples. The strong correlation peak at a delay of 52 samples indicates a pitch of 52 samples. This is verified by FIG. 10A, where the time domain peaks in frame 1 are separated by 52 samples. This is the only peak whose value is above the clipping threshold and is the true pitch for that particular frame. However, examination of frame 2 in FIG. 10A shows that the time domain waveform has amplitude peaks separated by 57 samples, whereas the correlation method in FIG. 10B shows a single peak above the clipping threshold at a delay of 113 samples.

Similarly, for frames 3 and 4, the correlation function in FIG. 10B produces single peaks above the clipping threshold at sample delays of 58 and 115 samples, respectively. The two single peaks at sample delays of 113 and 115 in frames 2 and 4 respectively, are second multiples of the true pitch. If these peaks are not corrected for, they will produce a pitch halving effect in the synthesized speech. This pitch halving effect introduces a low popping artifact into the output speech. The vocoder of the present invention includes an improved system and method for accurately determining the true pitch, even when correlation detection erroneously detects second or higher multiples of the true pitch.

Figure 11A:
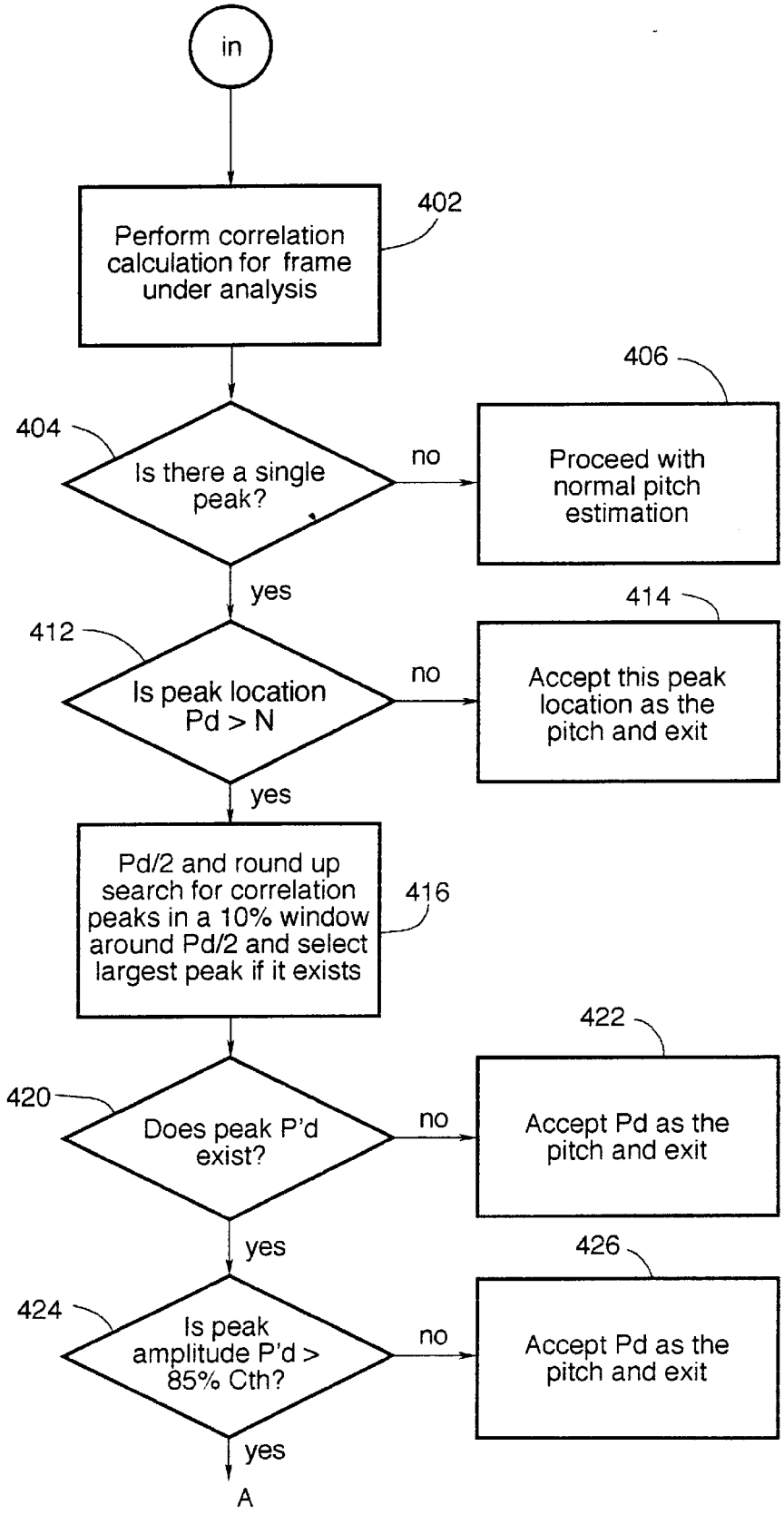
FIG. 11 is a flowchart diagram illustrating operation of the pitch error correction method of the present invention.
Figure 11B:
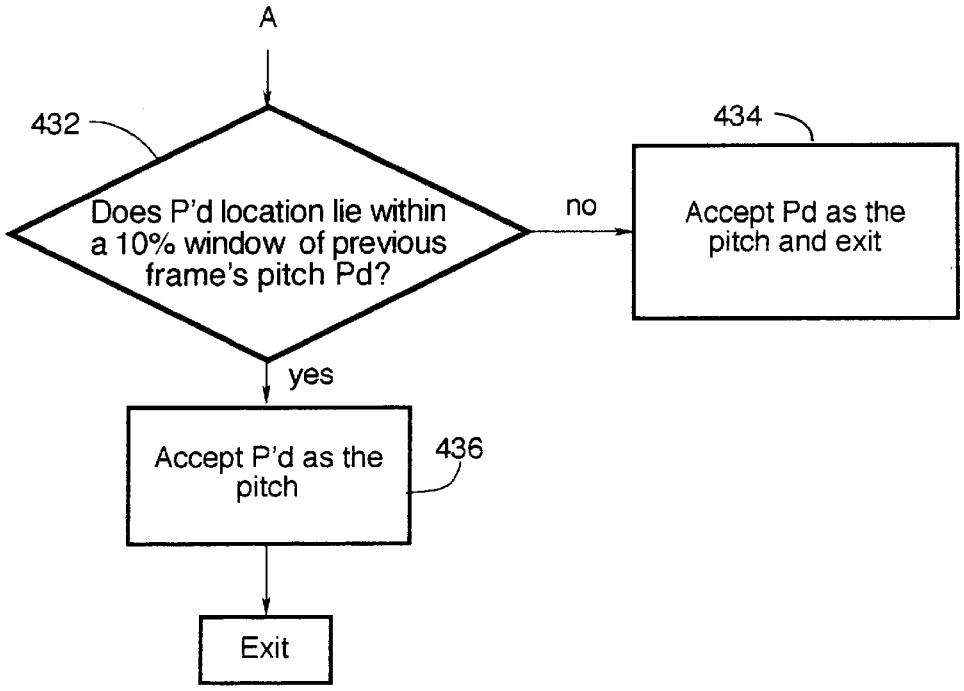

FIG. 11—Flowchart Diagram

Referring now to FIG. 11, a flowchart diagram illustrating operation of the pitch error correction method of the present invention is shown. FIG. 11 illustrates a portion of the steps performed in step 208 of FIG. 9. It is noted that the steps of FIG. 11 are performed for a plurality of frames of the speech waveform.

In step 402 the vocoder performs correlation calculations for the frame under analysis. The correlation calculation is preferably performed using equations 1, 2 and 3 which are recited below.

$$corcoef = \frac{\sum_{n=0}^{N-1} [x(n) - \bar{x}][x(n-d) - \overline{xd}]}{\sum_{n=0}^{N-1} [x(n) - \bar{x}]^2 * \sum_{n=0}^{N-1} [x(n-d) - \overline{xd}]^2} \quad \text{Eqn (1)}$$

where $$\bar{x} = \frac{1}{N} \sum_{n=0}^{N-1} [x(n)] \text{ and } \overline{x(d)} = \frac{1}{N} \sum_{n=0}^{N-1} [x(n-d)] \quad \text{Eqn's (2)\&(3)}$$

The results of the correlation calculation are illustrated in FIG. 10B for the speech waveform of FIG. 10A. In step 404 the vocoder determines if there is a single peak in the correlation calculation which is above the clipping threshold. If multiple peaks, i.e., two or more peaks, exist above the respective clipping threshold, i.e., there is not only a single peak above the clipping threshold, the system proceeds with a normal prior art pitch estimation method in step 406. The normal pitch estimation method applies logic to each of the peaks to estimate the pitch of the speech waveform, as is well known in the art. The case where only a single correlation peak exists above the respective clipping threshold occurs in all of the frames of FIG. 10B.

If in step 404 the vocoder determines that there is only a single peak in the correlation calculation which is above the clipping threshold, then in step 412 the vocoder determines if the peak location $P_d$ of this peak is greater than a peak location limit threshold parameter N. Thus, if a single correlation peak exists, the vocoder examines the location $P_d$ of the single peak and compares it with a threshold parameter N. The peak location limit parameter N is a delay value which is obtained by experimentation, and the value N is set such that the location of the true pitch is presumed to be below this limit. The threshold parameter N is preferably dependent upon specific system assignments such as the actual configuration used for the correlation coefficient equation definition. In the preferred embodiment, the peak location limit parameter N is preferably set to 73 delay samples. If in step 412 the single peak $P_d$ is not greater than the threshold value of parameter N, then in step 414 the position of the single correlation peak is accepted as the true pitch, and operation completes.

If the peak location $P_d$ is greater than the threshold parameter N, i.e., the condition is true in step 412, then in step 416 a search is conducted for a possible pitch value or peak location $P_d$, where the pitch value $P_d$ is a second multiple of $P_d$. In other words, if only a single peak exists and the location of this single peak is greater than the peak location limit N, then the vocoder presumes that the single peak is not the true pitch, but rather is a multiple of the true pitch. The vocoder then performs calculations based on this presumption to more accurately avoid erroneous pitch estimates which are a multiple of the true pitch.

Thus, in the preferred embodiment, if only a single correlation peak is greater than the clipping threshold value, and this single peak is outside of the peak location limit range, the vocoder presumes that the peak location $P_d$ is a multiple of the true pitch. The vocoder computes one or more new peak locations, wherein the peak location $P_d$ is a multiple of these new peak locations, and searches for one or more correlation peaks within a window of each of these new locations. [It is noted that other criteria may be used to determine whether the maximum peak at $P_d$ is possibly a multiple of the true pitch.] For example, in one embodiment the maximum peak at $P_d$ is always presumed to be a multiple of the true pitch, and thus the search in step 416 is always conducted.

In the preferred embodiment, if the above criteria are met the vocoder presumes that the peak at location $P_d$ is the second multiple of the true pitch, and the vocoder computes a peak location which is the first multiple based on this assumption. Thus, in step 416 the vocoder divides the location value $P_d$ by two and rounds this value up to the nearest integer. This new value is then employed as a search point in the correlation peaks generated in step 402. As noted above, here the single peak at location $P_d$ determined in step 402 is presumed to be the second multiple of the true pitch, and the location value $P_d$ is divided by two in order to perform a search for this first multiple, which according to the above presumption is the true pitch. Thus, this search is conducted in order to find the true pitch if the determined peak location $P_d$ is actually the second multiple of the true pitch location.

In the preferred embodiment, a search is conducted within a window, preferably a +/−10% window, around the location of the possible true pitch. Thus, a search is conducted within a +/−10% window of the computed value $P_d/2$. The maximum of any detected peak is retained and its position is noted. In the preferred embodiment, a window of +/−10% is used for searching for correlation peaks. However, it is noted that other window values may be used as desired. In the example of FIG. 10, the search windows are shown in frames 2 and 4 of FIG. 10B in the region of the possible true pitch values. As shown in this example, these peaks exist and are only just below the clipping thresholds allocated to these particular peaks.

In step 420 the vocoder determines if a peak $P_d'$ exists within the window of the approximate location of $P_d/2$. If no peaks exist within the +/−10% window, then in step 422 the vocoder accepts the location value $P_d$ as the location of the true pitch, and operation completes. If a peak does exist within the +/−10% window in step 420, then operation proceeds to step 424. If a peak does exist within the window of the $P_d/2$ location, the location of this peak is referred to herein as $P_d'$. It is noted that the peak location $P_d'$ is approximately one half of the peak location $P_d$, and thus it is possible that $P_d'$ is the true pitch and $P_d$ is the second multiple of the true pitch.

In step 424 the vocoder determines if the peak amplitude of $P_d'$ is greater than 85% of the assigned clipping threshold for that peak. Thus, the level of the peak at $P_d'$ is compared to the clipping threshold. Thus, even though the peak amplitude of $P_d'$ is not greater than the clipping threshold, this test determines if the peak amplitude of $P_d'$ is sufficiently close to the clipping threshold to possibly be the true pitch. If the peak amplitude $P_d'$ is not greater than 85% of the assigned clipping threshold for that peak, then in step 426 the value $P_d$ is accepted as the true pitch and operation completes. If the peak amplitude of $P_d'$ is sufficiently large, this is evidence that the peak location $P_d'$ may be the true pitch.

If in step 424 the peak amplitude at location $P_d'$ is determined to be greater than 85% of the assigned clipping threshold for that peak, then in step 432 the vocoder determines if the $P_d'$ location lies within a 10% +/− window of the pitch location of the previous frame, referred to as $P_d^0$. In other words, in step 432 the vocoder compares the delay position or location $P_d'$ of this peak with the location of the pitch value $P_d'$ assigned to the previous frame. If the delay value is not within a +/−10% range of the pitch location $P_d^0$ of the previous frame, then in step 434 the value at location $P_d$ is accepted as the true pitch and operation completes. If the $P_d'$ location does lie within a 10% +/− window of the location $P_d$ of the previous frame's pitch, then in step 436 the value at location $P_d'$ is accepted as the true pitch and operation completes. Thus if the search in step 416 finds a peak location $P_d'$ having an amplitude which is sufficiently large and which is in the range of prior pitch values, then the peak location $P_d'$ is set on the true pitch.

Performance

The vocoder system and method of the present invention successfully corrects the pitch errors in frames 2 and 4 of FIG. 10B. The search windows are indicated in frames 2 and 4 of FIG. 10B in the region of the possible true pitch values. As shown, these peaks exist and are only just below the clipping thresholds allocated to these particular peaks. As also shown, the pitch values assigned to frames 1 and 3 are 52 and 58 sample delays respectively. The true pitch peaks in frames 2 and 4, which were found using the present invention, are both at sample delays of 57. These sample delays are well within the "10%" comparison threshold of the pitch peaks in frames 1 and 3, respectively.

Conclusion

Therefore, the present invention comprises an improved vocoder system and method for more accurately detecting the pitch of a sampled speech waveform. The present invention avoids erroneous pitch estimations which detect second or higher multiples of the true pitch.

Although the method and apparatus of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

I claim:

1. A method for estimating pitch in a speech waveform, wherein the speech waveform includes a plurality of frames each comprising a plurality of samples, the method comprising:

performing a correlation calculation on a first frame of the speech waveform, wherein the correlation calculation for said first frame produces one or more correlation peaks at respective numbers of delay samples;

determining a single correlation peak from said one or more correlation peaks, wherein said single correlation peak has a peak location $P_d$ comprising a first number of delay samples;

comparing the location $P_d$ of said single correlation peak with a threshold peak location limit after said determining said single correlation peak;

determining if the peak location $P_d$ of said single correlation peak is greater than said threshold peak location limit after said comparing the peak location $P_d$ of said single correlation peak with said threshold peak location limit;

searching for a peak location $P_d'$, wherein said peak location $P_d$ of said single correlation peak is a multiple of said peak location $P_d'$, and wherein said peak location $P_d'$ has a correlation peak, wherein said peak location $P_d'$ comprises a second number of delay samples; and setting said pitch equal to said second number of delay samples indicated by said peak location $P_d'$;

wherein said searching and said setting are performed in response to determining that the peak location $P_d$ of said single correlation peak is greater than said threshold peak location limit.

2. The method of claim 1, further comprising:

setting said pitch equal to said first number of delay samples indicated by said peak location $P_d$ if the peak location $P_d$ of said single correlation peak is not greater than said threshold peak location limit;

wherein said searching and said setting said pitch equal to said second number of delay samples indicated by said peak location $P_d'$ are not performed if the peak location $P_d$ of said single correlation peak is not greater than said threshold peak location limit.

3. The method of claim 1, wherein said determining said single correlation peak comprises:

comparing said one or more correlation peaks produced in said performing with a clipping threshold value;

determining if only a single correlation peak produced in the correlation calculation is greater than said clipping threshold value;

wherein said searching and said setting are not performed in response to determining that multiple correlation peaks are greater than said clipping threshold value.

4. The method of claim 3, further comprising:

setting said pitch equal to said first number of delay samples indicated by said peak location $P_d$ if said searching does not find said peak location $P_d'$;

wherein said setting said pitch equal to said second number of delay samples indicated by said peak location $P_d'$ is not performed if said searching does not find said peak location $P_d'$.

5. The method of claim 1, wherein said searching for said peak location $P_d'$ comprises:

computing one or more locations, wherein said peak location $P_d$ is a multiple of each of said one or more locations; and searching for one or more correlation peaks in a window of each of said one or more locations.

6. The method of claim 5, wherein said computing said one or more locations includes computing a location which is approximately one half of said peak location $P_d$;

wherein said searching searches for one or more correlation peaks in a window of said location which is approximately one half of said peak location $P_d$.

7. The method of claim 5, wherein said searching for said peak location $P_d'$ comprises searching for one or more correlation peaks in a +/−10% window of each of said one or more locations.

8. The method of claim 1, further comprising:

determining if the amplitude of said correlation peak at said peak location $P_d'$ is at least a first percentage of said clipping threshold; and setting said pitch equal to said first number of delay samples indicated by said peak location $P_d$ if the amplitude of said correlation peak at said peak location $P_d'$ is not at least said first percentage of said clipping threshold;

wherein said setting said pitch equal to said second number of delay samples indicated by said peak location $P_d'$ is not performed if the amplitude of said peak at said peak location $P_d'$ is not at least said first percentage of said clipping threshold.

9. The method of claim 1, wherein said first percentage of said clipping threshold comprises 85% of said clipping threshold.

10. The method of claim 1, wherein said speech waveform includes a previous frame which occurs immediately prior to said first frame; the method further comprising determining if said peak location $P_d'$ lies within a first window of a pitch value assigned to said previous frame; and setting said pitch equal to said first number of delay samples indicated by said peak location $P_d$ if said peak location $P_d'$ does not lie within said first window of said pitch value assigned to said previous frame;

wherein said setting said pitch equal to said second number of delay samples indicated by said peak location $P_d'$ is not performed if said peak location $P_d'$ does not lie within said first window of said pitch value assigned to said previous frame.

11. The method of claim 1, wherein said performing, said determining, said comparing, said determining, said searching, and said setting are performed for a plurality of frames of said speech waveform.

12. A method for estimating pitch in a speech waveform, wherein the speech waveform includes a plurality of frames each comprising a plurality of samples, the method comprising:

performing a correlation calculation on a first frame of the speech waveform, wherein the correlation calculation for said first frame produces one or more correlation peaks at respective numbers of delay samples;

determining a single correlation peak from said one or more correlation peaks, wherein said single correlation peak has a peak location $P_d$ comprising a first number of delay samples, wherein said determining comprises:

comparing said one or more correlation peaks produced in said performing with a clipping threshold value;

determining if only a single correlation peak produced in the correlation calculation is greater than said clipping threshold value, wherein said determining if only a single correlation peak is greater than said clipping threshold value determines that only a single correlation peak is greater than said clipping threshold value, wherein said single correlation peak has said peak location $P_d$ comprising said first number of delay samples;

searching for a peak location $P_d'$, wherein said peak location $P_d$ of said single correlation peak is a multiple of said peak location $P_d'$, and wherein said peak location $P_d'$ has a correlation peak, wherein said peak location $P_d'$ comprises a second number of delay samples; and setting said pitch equal to said second number of delay samples indicated by said peak location $P_d'$;

wherein said searching and said setting are performed in response to determining that only a single correlation peak is greater than said clipping threshold value;

wherein said searching for said peak location $P_d'$ comprises:

computing one or more locations, wherein said peak location $P_d$ is a multiple of each of said one or more locations; and searching for one or more correlation peaks in a window of each of said one or more locations;

wherein said computing said one or more locations includes computing a location which is approximately one half of said peak location $P_d$; and wherein said searching searches for one or more correlation peaks in a window of said location which is approximately one half of said peak location $P_d$.

13. The method of claim 12, wherein said searching for said peak location $P_d'$ comprises searching for one or more correlation peaks in a +/−10% window of each of said one or more locations.

14. The method of claim 12, wherein said determining said single correlation peak further comprises:

estimating the pitch from said one or more correlation peaks if multiple correlation peaks are greater than said clipping threshold value, wherein said estimating determines said single correlation peak;

wherein said searching and said setting are not performed in response to determining that multiple correlation peaks are greater than said clipping threshold value.

15. The method of claim 12, further comprising:

comparing the location $P_d$ of said single correlation peak with a threshold peak location limit after said determining said single correlation peak;

determining if the peak location $P_d$ of said single correlation peak is greater than said threshold peak location limit after said comparing the peak location $P_d$ of said single correlation peak with said threshold peak location limit; and setting said pitch equal to said first number of delay samples indicated by said peak location $P_d$ if the peak location $P_d$ of said single correlation peak is not greater than said threshold peak location limit;

wherein said searching and said setting said pitch equal to said second number of delay samples indicated by said peak location $P_d'$ are not performed if the peak location $P_d$ of said single correlation peak is not greater than said threshold peak location limit.

16. The method of claim 12, further comprising:

setting said pitch equal to said first number of delay samples indicated by said peak location $P_d$ if said searching does not find said peak location $P_d'$;

wherein said setting said pitch equal to said second number of delay samples indicated by said peak location $P_d'$ is not performed if said searching does not find said peak location $P_d'$.

17. The method of claim 12, wherein said speech waveform includes a previous frame which occurs immediately prior to said first frame; the method further comprising determining if said peak location $P_d'$ lies within a first window of a pitch value assigned to said previous frame; and setting said pitch equal to said first number of delay samples indicated by said peak location $P_d$ if said peak location $P_d'$ does not lie within said first window of said pitch value assigned to said previous frame;

wherein said setting said pitch equal to said second number of delay samples indicated by said peak location $P_d'$ is not performed if said peak location $P_d'$ does not lie within said first window of said pitch value assigned to said previous frame.

18. The method of claim 12, wherein said performing, said comparing, said determining, said searching, and said setting are performed for a plurality of frames of said speech waveform.

19. A method for estimating pitch in a speech waveform, wherein the speech waveform includes a plurality of frames each comprising a plurality of samples, the method comprising:

performing a correlation calculation on a first frame of the speech waveform, wherein the correlation calculation for said first frame produces one or more correlation peaks at respective numbers of delay samples;

determining a single correlation peak from said one or more correlation peaks, wherein said single correlation peak has a peak location $P_d$ comprising a first number of delay samples, wherein said determining comprises:

comparing said one or more correlation peaks produced in said performing with a clipping threshold value; and determining if only a single correlation peak produced in the correlation calculation is greater than said clipping threshold value, wherein said determining if only a single correlation peak is greater than said clipping threshold value determines that only a single correlation peak is greater than said clipping threshold value, wherein said single correlation peak has said peak location $P_d$ comprising said first number of delay samples;

searching for a peak location $P_d'$, wherein said peak location $P_d$ of said single correlation peak is a multiple of said peak location $P_d'$, and wherein said peak location $P_d'$ has a correlation peak, wherein said peak location $P_d'$ comprises a second number of delay samples; and setting said pitch equal to said second number of delay samples indicated by said peak location $P_d'$;

wherein said searching and said setting are performed in response to determining that only a single correlation peak is greater than said clipping threshold value;

determining if the amplitude of said correlation peak at said peak location $P_d'$ is at least a first percentage of said clipping threshold; and setting said pitch equal to said first number of delay samples indicated by said peak location $P_d$ if the amplitude of said correlation peak at said peak location $P_d'$ is not at least said first percentage of said clipping threshold;

wherein said setting said pitch equal to said second number of delay samples indicated by said peak location $P_d'$ is not performed if the amplitude of said peak at said peak location $P_d'$ is not at least said first percentage of said clipping threshold; and wherein said first percentage of said clipping threshold comprises 85% of said clipping threshold.

* * * * *